US008574373B2

(12) United States Patent
Delgado et al.

(10) Patent No.: US 8,574,373 B2
(45) Date of Patent: Nov. 5, 2013

(54) METHOD OF OPERATING A DISHWASHER

(75) Inventors: Kristopher L. Delgado, Stevensville, MI (US); Barry E. Tuller, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 76 days.

(21) Appl. No.: 13/171,909

(22) Filed: Jun. 29, 2011

(65) Prior Publication Data

US 2013/0000673 A1 Jan. 3, 2013

(51) Int. Cl.

| | |
|---|---|
| ***B08B 9/20*** | (2006.01) |
| *A47L 15/18* | (2006.01) |
| *A47L 15/46* | (2006.01) |

(52) U.S. Cl.
USPC ..... 134/25.2; 134/58 D; 134/199; 134/200

(58) Field of Classification Search
USPC ..... 134/18, 25.2, 29, 57 D, 57 DL, 56 D, 134/58 D, 58 DL
See application file for complete search history.

(56) References Cited

U.S. PATENT DOCUMENTS

| | | | | |
|---|---|---|---|---|
| 5,729,025 | A | 3/1998 | Erickson et al. | |
| 5,829,459 | A | 11/1998 | Milocco et al. | |
| 6,605,157 | B2 | 8/2003 | Hegeman | |
| 6,623,565 | B2 | 9/2003 | Rosenbauer et al. | |
| 7,445,013 | B2 | 11/2008 | Vanderroest et al. | |
| 7,523,758 | B2 | 4/2009 | Vanderroest et al. | |
| 7,635,003 | B2 | 12/2009 | Lee | |
| 8,161,995 | B2 | 4/2012 | Armstrong et al. | |
| 2006/0054198 | A1 | 3/2006 | Choi | |
| 2010/0043826 | A1 * | 2/2010 | Bertsch et al. | 134/18 |

FOREIGN PATENT DOCUMENTS

| | | | |
|---|---|---|---|
| DE | 102009002667 | A1 | 10/2010 |
| GB | 1469338 | | 4/1977 |
| JP | 64-27528 | A | 1/1989 |
| JP | 1262831 | A | 10/1989 |
| KR | 20070080294 | A | 8/2007 |
| KR | 20100023174 | A | 3/2010 |
| WO | 2008125482 | A2 | 10/2008 |

* cited by examiner

*Primary Examiner* — Michael Kornakov
*Assistant Examiner* — Caitlin N Dunlap

(57) ABSTRACT

A method of operating a dishwasher includes storing wash liquid in a portion of the spray system of the dishwasher for subsequent reuse. The spray system can include one or more supply conduits, and wash liquid can be alternatively supplied to the supply conduits to store the wash liquid in at least one of the supply conduits.

9 Claims, 6 Drawing Sheets

METHOD OF OPERATING A DISHWASHER

BACKGROUND OF THE INVENTION

Contemporary dishwashers for use in a typical household include a tub defining a treating chamber in which utensils are placed for cleaning of the stored utensils during an automatic cycle of operation, such as a wash cycle. Dishwashers include spray systems having one or more sprayers which are supplied with liquid by supply conduits. Wash liquid is recirculated through the treating chamber by a wash pump which fluidly couples the treating chamber to the supply conduits to recirculate liquid in the treating chamber.

Some dishwashers may be provided with a separate, dedicated tank for storing liquid captured from the wash tub during a previous cycle of operation or a phase of a cycle of operation. The tank can be provided within the housing of the dishwasher. The stored liquid is then used in the same wash cycle or a subsequent wash cycle.

BRIEF DESCRIPTION OF THE INVENTION

In one aspect, the invention relates to a method of operating a dishwasher having a treating chamber supplied with wash liquid by a spray system having multiple, independent supply conduits terminating in at least one sprayer. The method comprises recirculating wash liquid from the treating chamber to the spray system, while recirculating the wash liquid, alternatively supplying the recirculated wash liquid to the supply conduits to store the wash liquid in at least one of the supply conduits, terminating the recirculation of wash liquid when a predetermined amount of wash liquid is stored, and draining any remaining wash liquid.

In another aspect, the invention relates to a method of operating a dishwasher having a treating chamber supplied with wash liquid by a spray system having at least one supply conduit terminating in at least one sprayer. The method comprises recirculating wash liquid from the treating chamber to the spray system, while recirculating the wash liquid, storing a portion of the wash liquid in the at least one supply conduit by supplying the recirculated wash liquid to the at least one supply conduit, terminating the recirculation of wash liquid when a predetermined amount of wash liquid is stored, and draining any remaining wash liquid.

DESCRIPTION OF EMBODIMENTS OF THE INVENTION

The invention is generally directed toward the reuse of liquid in a dishwasher. The particular approach of the invention is to capture liquid from a phase, such as a wash or rinse phase, of a cycle of operation and store the liquid in a portion of the spray system of the dishwasher 10 for reuse in a subsequent phase of the same or subsequent cycle of operation.

Figure 1:
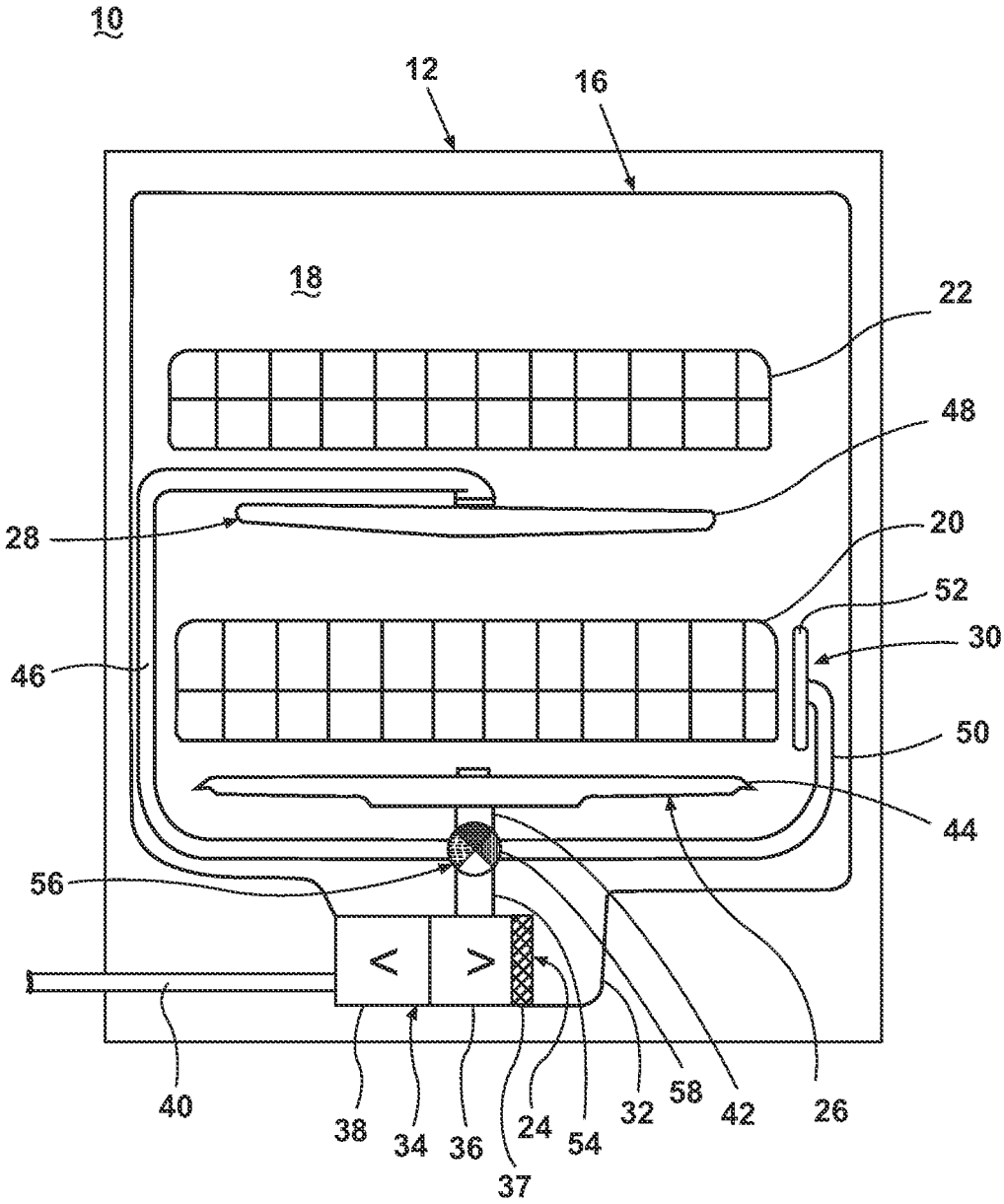
FIG. 1 is a schematic, side view of a dishwasher which may be used to implement a method according to the invention.

FIG. 1 is a schematic, side view of a dishwasher 10 according to an embodiment of the invention and which may be used to implement a method according to the invention. The dishwasher 10 shares many features of a conventional automatic dishwasher which will not be described in detail herein except as necessary for a complete understanding of the invention. The dishwasher 10 may have a cabinet 12 defining an interior, which is accessible through a door (not shown) that is pivotally mounted to the cabinet 12 for providing access to the interior. At least one wash tub 16 is provided within the interior of the cabinet 12 and defines a treating chamber 18 for receiving and treating utensils according to a cycle of operation, often referred to as a wash cycle, regardless of whether washing occurs. For purposes of this description, the term "utensil(s)" is intended to be generic to any item, single or plural, that may be treated in the dishwasher 10, including, without limitation; dishes, plates, pots, bowls, pans, glassware, and silverware. While the illustrated dishwasher 10 is a free-standing dishwasher with a single tub 16 closed by a door, other dishwashers 10 are possible, non-limiting examples of which include in-sink dishwashers, multi-tub dishwashers, or drawer-type dishwashers.

Utensil holders, illustrated as lower and upper racks 20, 22 are located within the treating chamber 18 and receive utensils for treating. The racks 20, 22 are typically mounted for slidable movement in and out of the treating chamber 18 for ease of loading and unloading utensils. While not shown, additional utensil holders, such as a silverware basket on the interior of the door, can also be provided.

The dishwasher 10 further includes a liquid supply system 24 for introducing and recirculating liquid and wash aids, such as detergents, rinse aids, and the like, throughout the treating chamber 18. Liquid which has been introduced and recirculated through the treating chamber 18 to remove soil from utensils, regardless of whether the liquid includes any wash aids and of whether the liquid is used during a wash phase of a cycle of operation, may be referred to as wash liquid.

The liquid supply system 24 can comprise a spray system having at least one spray assembly for spraying liquid into the treating chamber 18. As shown herein, the spray system includes a first spray assembly 26, a second spray assembly 28, and a third spray assembly 30.

Each spray assembly 26, 28, 30 of the liquid supply system 24 can include one or more liquid supply conduits which terminate in at least one liquid sprayer. The sprayers generally form the outlets of the supply conduits. As illustrated, the first spray assembly 26 comprises a first supply conduit 42 which terminates in a lower spray arm 44. The lower spray arm 44 can be rotatably mounted within the treating chamber 18 below the bottom of the lower rack 20 and can provide a liquid spray upwardly through the bottom of the lower rack 20. The second spray assembly 28 comprises a second supply conduit 46 which terminates in an upper spray arm 48. The upper spray arm 48 can be rotatably mounted within the treating chamber 18 below the bottom of the upper rack 22 and can provide a liquid spray upwardly through the bottom of the upper rack 22. The third spray assembly 30 comprises a third supply conduit 50 which terminates in a spray manifold 52. The spray manifold 52 can be fixedly mounted to the tub 16 adjacent to the lower rack 20 and can provide a liquid spray laterally through a side of the lower rack 20. The spray manifold 52 may not be limited to this position; rather, the spray manifold 52 can be located in virtually any part of the treating chamber 18. While not illustrated herein, the spray manifold 52 may comprise multiple spray nozzles having apertures configured to spray wash liquid towards and/or through the lower rack 20. The spray nozzles may be fixed or rotatable with respect to the tub 16. Suitable spray manifolds are set forth in detail in U.S. Pat. No. 7,445,013, issued Nov. 4, 2008, and titled "Multiple Wash Zone Dishwasher," and U.S. Pat. No. 7,523,758, issued Apr. 28, 2009, and titled "Dishwasher Having Rotating Zone Wash Sprayer," both of which are incorporated herein by reference in their entirety.

The liquid supply system 24 further comprises a recirculation system having a lower portion or sump 32 formed in the tub 16 which collects liquid sprayed into the treating chamber 18 by the spray system, and a pump assembly 34 fluidly coupled to the sump 32. The pump assembly 34, as illustrated, may include a wash pump 36 and a drain pump 38. The wash pump 36 fluidly couples the sump 32 to the spray assemblies 26, 28, 30 for recirculating wash liquid collected in the sump 32 to the spray assemblies 26, 28, 30. The wash pump 36 may include a filter 37 for filtering wash liquid prior to supplying the wash liquid to the spray assemblies 26, 28, 30. The drain pump 38 fluidly couples the sump 32 to a drain conduit 40 for draining wash liquid collected in the sump 32 to a household drain line (not shown), such as a sewer line, or the like. While the pump assembly 34 is illustrated as having separate wash and drain pumps 36, 38 in an alternative embodiment, the pump assembly 34 may include a single pump configured to selectively supply wash liquid to either the spray assemblies 26, 28, 30 or the drain conduit 40, such as by configuring the pump to rotate in opposite directions, or by providing a suitable valve system. While not shown, the liquid supply system 24 can further comprise a water supply conduit and valve coupled to a household water supply for selectively supplying water to the sump 32.

The wash pump 36 can selectively supply wash liquid to each spray assembly 26, 28, 30. As shown herein, the wash pump 36 has an outlet conduit 54 in fluid communication with the spray system for discharging wash liquid from the wash pump 36 to the spray assemblies 26, 28, 30. A diverter mechanism 56 can be provided between the outlet conduit 54 and the inlets to each supply conduit 42, 46, 50, such that the wash pump 36 can selectively supply wash liquid to each of the first, second, and third spray assemblies 26, 28, 30 individually. As such, the diverter mechanism can selectively close the inlets to the supply conduits 42, 46, 50. The diverter mechanism 56 can comprise a diverter valve 58. One embodiment of a suitable diverter valve 58 comprises a rotatable disk (not shown) having at least one opening which can be selectively aligned with the supply conduits 42, 46, 50 directly or with passages leading to the supply conduits 42, 46, 50. By indexing the disk such that the opening is directly or indirectly aligned with one of the supply conduits 42, 46, 50, wash liquid may be diverted between the different spray assemblies 26, 28, 30. Details of a suitable diverter valve are set forth in detail in U.S. patent application Ser. No. 12/193,823, filed Aug. 19, 2008, and titled "Sequencing Spray Arm Assembly for a Dishwasher," which is incorporated herein by reference in its entirety.

While not shown in FIG. 1, the dishwasher 10 can further include a separate storage tank for storing a quantity of wash liquid for later reuse. Thus, in addition to the spray system, wash liquid from one phase of a cycle of operation can be captured and stored in the storage tank for reuse in a subsequent phase of the same or subsequent cycle of operation.

Figure 2:
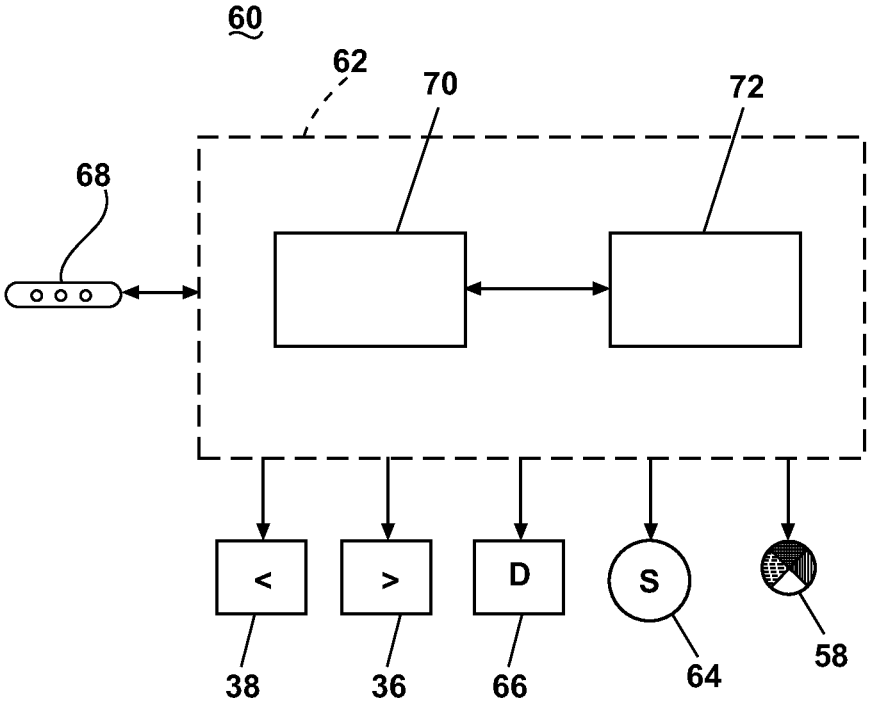
FIG. 2 is a schematic view of a control system of the dishwasher of FIG. 1.

FIG. 2 is a schematic view of a control system 60 of the dishwasher 10 of FIG. 1. As illustrated, the control system 60 comprises a controller 62 that may be operably coupled to various components of the dishwasher 10 to implement a wash cycle in the treating chamber 18. For example, the controller 62 may be coupled with the wash pump 36 for circulation of liquid in the tub 16 and the drain pump 38 for drainage of liquid from the tub 16. The controller 62 may also be coupled with the diverter valve 58 for selectively supplying wash liquid to the spray assemblies 26, 28, 30. The controller 62 may also receive inputs from one or more other sensors 64, examples of which are known in the art. Non-limiting examples of sensors 64 that may be communicably coupled with the controller include a temperature sensor, a moisture sensor, a door sensor, a detergent and rinse aid presence/type sensor(s). The controller 62 may also be coupled to one or more dispenser(s) 66, which may dispense a detergent into the treating chamber 18 during the wash step of the cycle of operation or a rinse aid during the rinse step of the cycle of operation.

The dishwasher 10 may be preprogrammed with a number of different wash cycles from which a user may select one wash cycle to clean a load of utensils. Examples of wash cycles include normal, light/china, heavy/pots and pans, and rinse only. A control panel or user interface 68 for use in selecting a wash cycle can be provided on the dishwasher 10 and coupled to the controller 62. Alternately, the wash cycle may be automatically selected by the controller 62 based on soil levels sensed by the dishwasher 10 to optimize the cleaning performance of the dishwasher 10 for a particular load of utensils.

The controller 62 may be provided with a memory 70 and a central processing unit (CPU) 72. The memory 70 may be used for storing control software that may be executed by the CPU 72 in completing a cycle of operation and any additional software. For example, the memory 70 may store one or more pre-programmed cycles of operation that may be selected by a user via the user interface 68. A cycle of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing.

FIGS. 3-6 are schematic, front views of the dishwasher 10 of FIG. 1, illustrating the diverter valve 58 in one of four positions. The above-described dishwasher 10 can be used to implement a method for operating a dishwasher. In operation, for a spray system having three spray assemblies 26, 28, 30, as is shown herein, the diverter mechanism 56 can move between at least four positions: a first position, shown in FIG. 3, in which the outlet conduit 54 is fluidly coupled with the first supply conduit 42; a second position, shown in FIG. 4, in which the outlet conduit 54 is fluidly coupled with the second supply conduit 46; a third position, shown in FIG. 5, in which the outlet conduit 54 is fluidly coupled with the third supply conduit 50; a fourth position, shown in FIG. 6, in which the outlet conduit 54 is fluidly uncoupled from all of the supply conduits 42, 46, 50.

Figure 3:
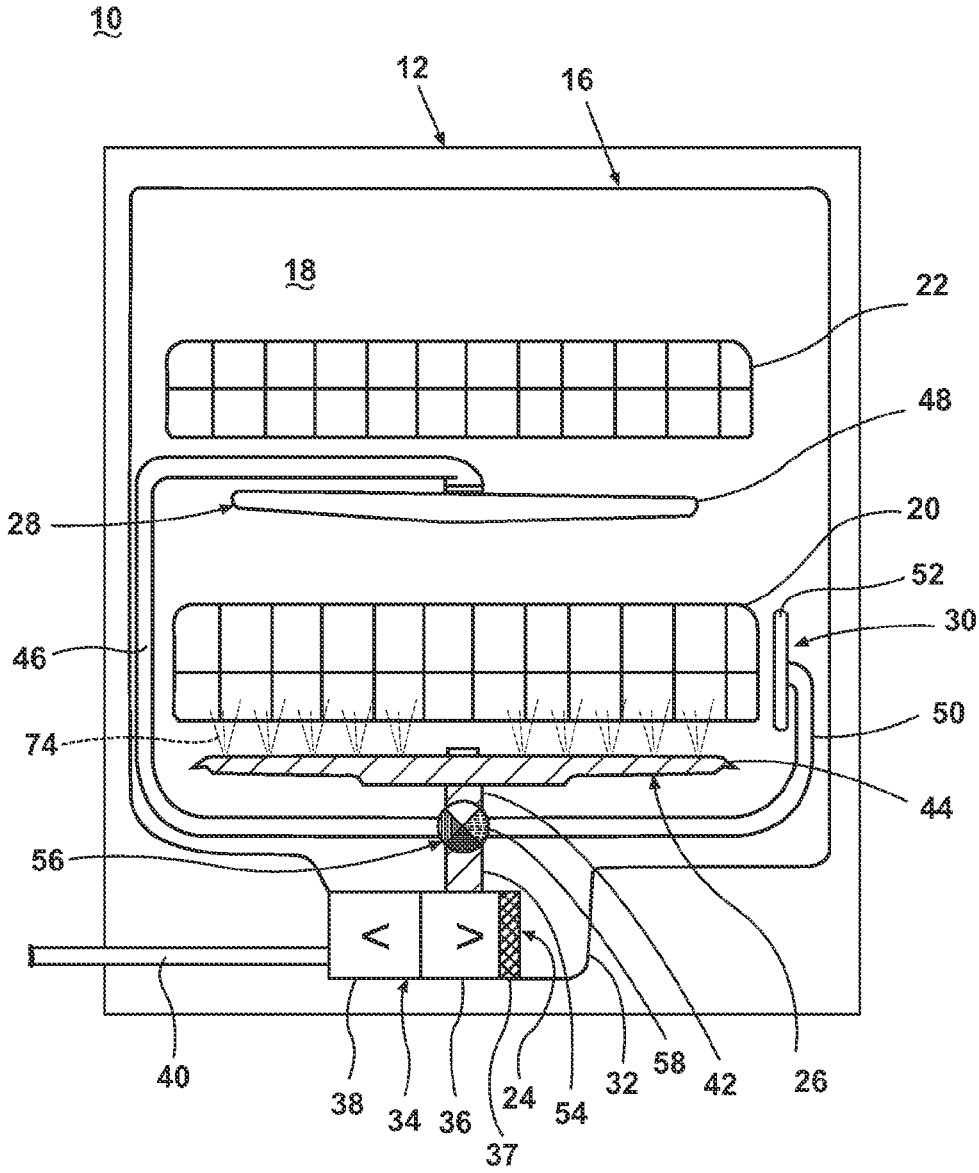
FIG. 3 is a schematic, side view of the dishwasher of FIG. 1, illustrating a diverter mechanism in a first position and wash liquid being sprayed from a first spray assembly.
Figure 4:
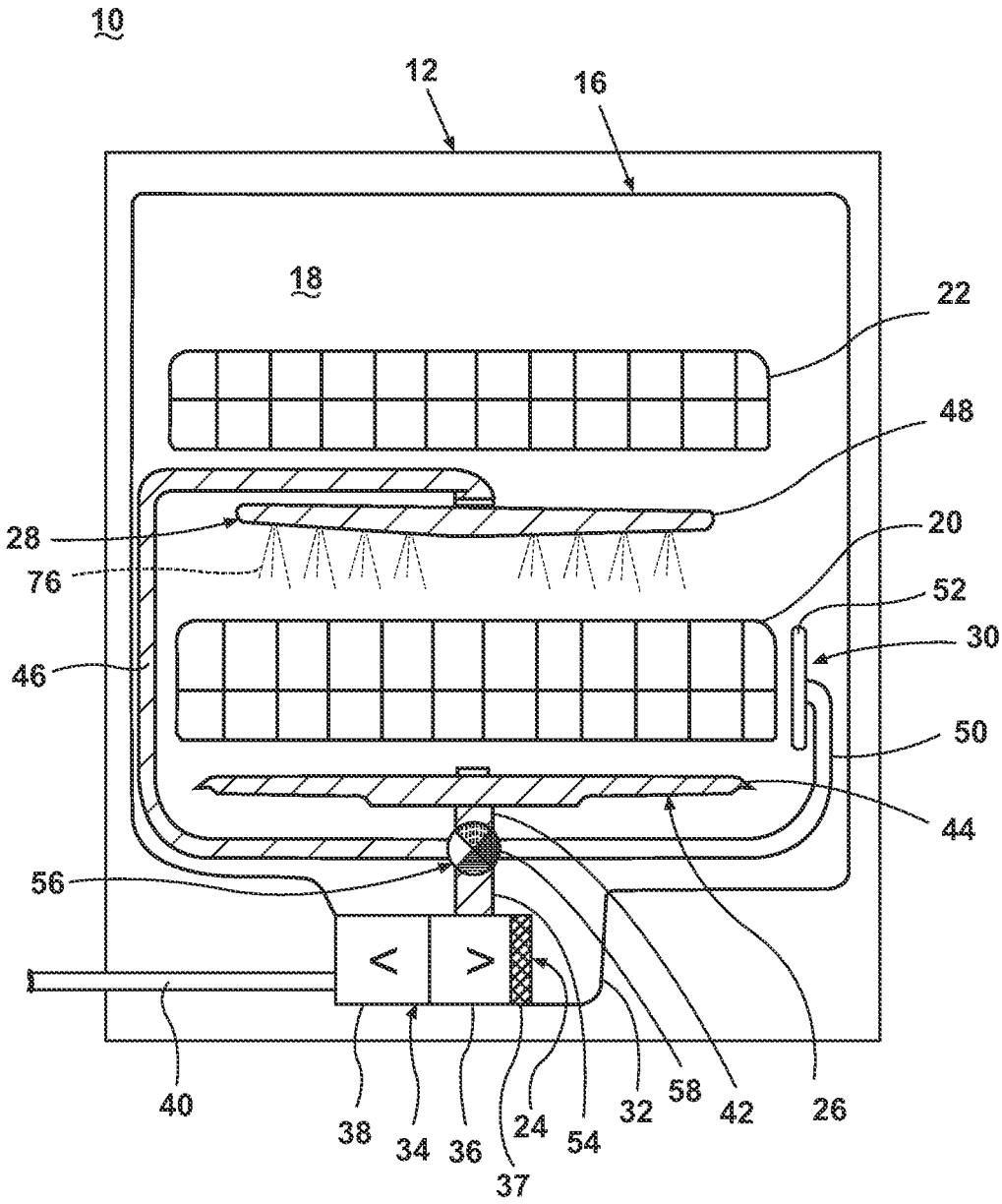
FIG. 4 is a schematic, side view of the dishwasher of FIG. 1, illustrating a diverter mechanism in a second position and wash liquid being sprayed from a second spray assembly.
Figure 5:
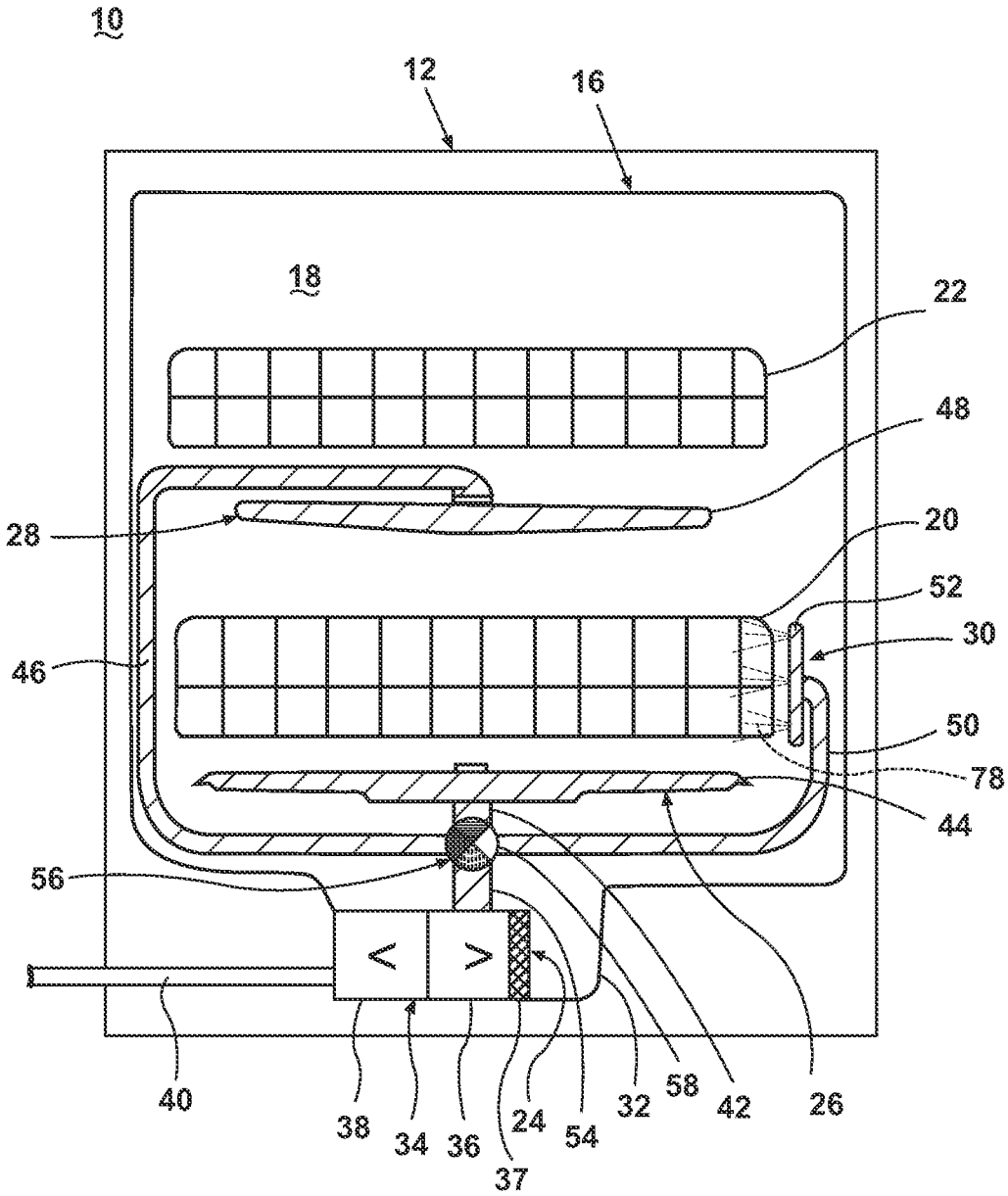
FIG. 5 is a schematic, side view of the dishwasher of FIG. 1, illustrating a diverter mechanism in a third position and wash liquid being sprayed from a third spray assembly.
Figure 6:
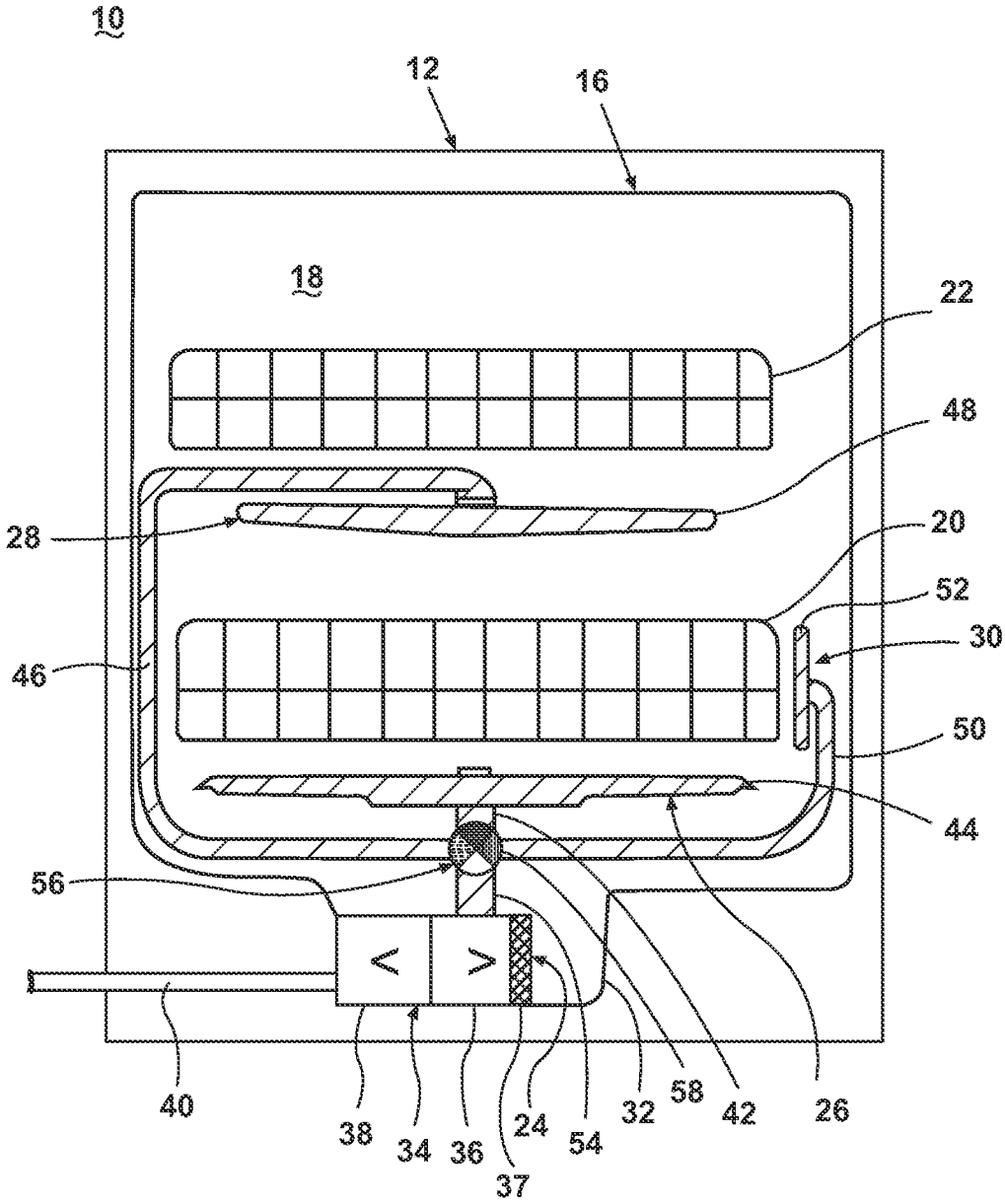
FIG. 6 is a schematic, side view of the dishwasher of FIG. 1, illustrating a diverter mechanism in a fourth position and wash liquid stored with the first, second, and third spray assemblies.

In general, the first, second, and third positions shown in FIGS. 3-5 may be referred to as 'open' positions, since the inlets of the supply conduits 42, 46, 50 are open and wash liquid can flow to one of the spray assemblies 26, 28, 30. The fourth position shown in FIG. 6 may be referred to as a 'closed' position, since the inlets of the supply conduits 42, 46, 50 are closed and wash liquid cannot flow to any of the spray assemblies 26, 28, 30. Further, in the first position, shown in FIG. 3, the outlet conduit 54 is not in fluid communication with the second or third supply conduits 46, 50, and, therefore, may be thought of as a 'closed' position for the second and third spray assemblies 28, 30 since wash liquid cannot flow to the second and third supply conduits 46, 50. In the second position, shown in FIG. 4, the outlet conduit 54 is not in fluid communication with the first or third conduits 42, 50, and, therefore, may be thought of as a 'closed' position for the first and third spray assemblies 26, 30, since wash liquid cannot flow to the first and third supply conduits 42, 50. In the third position, shown in FIG. 5, the outlet conduit 54 is not in fluid communication with the first or second supply conduits 42, 46, and, therefore, may be thought of as a 'closed' position for the first and second spray assemblies 26, 28 since wash liquid cannot flow to the first and second supply conduits 42, 46.

While described herein as supplying wash liquid can be supplied to the first, second, and third spray assemblies 26, 28, 30 individually, the diverter mechanism 56 can be configured to supply wash liquid to a combination of the first, second, and third spray assemblies 26, 28, 30, and/or to all of the spray assemblies 26, 28, 30 simultaneously.

By sequencing the diverter valve 58 through all four positions shown in FIGS. 3-6 with the wash pump 36 activated, wash liquid can be sequentially supplied to each of the spray assemblies 26, 28, 30. When the diverter valve 58 is moved from an opened position to a closed position for any of the spray assemblies 26, 28, 30, any wash liquid still in the spray assemblies 26, 28, 30 will become trapped within at least a portion of the supply conduit 42, 46, 50, and optionally the sprayers 44, 48, 52, and will not be sprayed from the spray arms 44, 48 or spray manifold 52, respectively. This effectively stores the wash liquid within the spray assemblies 26, 28, 30. Since the wash pump 36 can also be provided with the filter 37, the wash liquid stored in the spray assemblies 26, 28, 30 may be filtered prior to supplying the wash liquid to the spray assemblies 26, 28, 30.

One example of a method for sequencing of operating the diverter valve 58 is described below. It will be apparent to one of ordinary skill that the operation of the diverter valve 58 can proceed in other orders and is not limited to the sequence presented below. The following description is for illustrative purposes only and is not intended to limit the invention in any manner. The method begins under the assumption that the spray assemblies 26, 28, 30 are substantially empty, as shown in FIG. 1, but that there is wash liquid available in the treating chamber 18. For example, the method may include first supplying liquid to the treating chamber 18 and recirculating the liquid through the treating chamber 18 to remove soils from any utensils within the treating chamber 18 and to form the wash liquid.

Activating the wash pump 36 will recirculate the wash liquid from the sump 32 of the treating chamber 18 to the spray assemblies 26, 28, 30. The diverter 58 can be sequentially advanced between the four positions to alternatively supply recirculated wash liquid to the spray assemblies 26, 28, 30.

When the wash pump 36 is activated with the diverter valve 58 in the first position, as shown in FIG. 3, wash liquid is supplied to the first supply conduit 42 of the first spray assembly 26. Wash liquid may be sprayed from the lower spray arm 44 in a first spray pattern 74. Thereafter moving the diverter valve 58 to any of the other three positions, such as the second position shown in FIG. 4, will store wash liquid in the first supply conduit 42, and optionally also in the lower spray arm 44.

When the wash pump 36 is activated with the diverter valve 58 in the second position, as shown in FIG. 4, wash liquid is supplied to the second supply conduit 46 of the second spray assembly 28. Wash liquid may be sprayed from the upper spray arm 48 in a second spray pattern 76. Thereafter moving the diverter valve 58 to any of the other three positions, such as the third position shown in FIG. 5, will store wash liquid in the second supply conduit 46, and optionally, also in the upper spray arm 48. The wash liquid in the first spray assembly 26 also remains stored therein.

When the wash pump 36 is activated with the diverter valve 58 in the third position, as shown in FIG. 5, wash liquid is supplied to the third supply conduit 50 of the third spray assembly 30. Wash liquid may be sprayed from the spray manifold 58 in a third spray pattern 78. Thereafter moving the diverter valve 58 to any of the other three positions, such as the fourth position shown in FIG. 6, will store wash liquid in the third supply conduit 50, and optionally also in the spray manifold 52. The wash liquid in the first spray assembly 26 and the second spray assembly 28 also remains stored therein.

With the diverter valve 58 in the fourth position, as shown in FIG. 1, the wash pump 36 is fluidly uncoupled from all of the supply conduits 42, 46, 50 and wash liquid cannot be not supplied to any of the supply conduits 42, 46, 50 even if the wash pump 36 is active. In the fourth position, any wash liquid in the spray assemblies 26, 28, 30 will remain stored therein.

The recirculation of wash liquid, i.e. the operation of wash pump 36, can be terminated when a predetermined amount of wash liquid is stored in the spray assemblies 26, 28, 30. For example, recirculation can be terminated when one of the spray assemblies 26, 28, 30 is filled, or when each spray assemblies 26, 28, 30 is filled, or when any other sub-combination of the spray assemblies 26, 28, 30 is filled. It is contemplated that wash liquid may not fill the entire capacity of the spray assemblies 26, 28, 30, but that each of the spray assemblies 26, 28, 30 may have an average storage capacity defined by the amount of wash liquid that is stored within each spray assemblies 26, 28, 30 on average. The combined average storage capacity of the spray assemblies 26, 28, 30 can define a maximum capacity of the spray system. The predetermined amount of wash liquid can, therefore, comprise an amount of wash liquid approximately equal to the maximum capacity of the spray system, or the combined average storage capacity of any other sub-combination of the spray assemblies 26, 28, 30. Since it is relatively easy to determine the capacity of the spray assemblies 26, 28, 30, the amount of stored wash liquid can be known and taken into account in the next phase or wash cycle.

After the predetermined amount of wash liquid is stored in the spray assemblies 26, 28, 30, any wash liquid otherwise remaining in the sump 32 of the treating chamber 18 can optionally be drained from the dishwasher 10 by activating the drain pump 38.

During a subsequent phase of the same wash cycle or a subsequent wash cycle, the diverter 58 can be opened to drain wash liquid from the spray assemblies 26, 28, 30 to the sump 32, with or without operation of the wash pump 36. The stored wash liquid can thereafter be used in the subsequent phase or wash cycle.

Due to the configuration of typical dishwasher wash pumps 36, when the wash pump 36 is activated and the diverter valve 58 is in one of the open positions, the associated spray assemblies 26, 28, 30 will be filled to the average storage capacity within a few seconds. Therefore, the diverter valve 58 can be controlled by timing and sequenced every few seconds to effectively fill each spray assembly 26, 28, 30. Once one spray assembly 26, 28, 30 is filled, the position of the diverter valve 58 can be advanced to another position to fill a different spray assembly 26, 28, 30 or to terminate storing, such as when the diverter valve 58 is in the fourth position shown in FIG. 6.

Optionally, prior to storing wash liquid in the spray assemblies 26, 28, 30, the drain pump 38 can be operated for an initial period of time to remove a predetermined amount of the liquid. It can be assumed that the portion of the wash liquid lowest in the sump 32, i.e. closest to the drain pump 38, is more highly soiled since larger soils will tend to settle. Initially operating the drain pump 38 can, therefore, improve the quality of the wash liquid subsequently stored in the spray assemblies 26, 28, 30 by draining a highly soiled portion of the wash liquid.

While stored wash liquid is shown as filling substantially the entire spray assemblies 26, 28, 30, including the supply conduits 42, 46, 50 and sprayers 44, 48, 52, in FIGS. 3-6, it is contemplated that the entire spray assemblies 26, 28, 30 may not be filled during a storage operation. Some wash liquid may drain out of the spray assemblies 26, 28, 30 through the outlets in the sprayers 44, 48, 52. For example, if any of the spray assemblies 26, 28, 30 have downwardly-facing or otherwise easily drainable outlets, it may not be feasible to store wash liquid in those spray assemblies 26, 28, 30 since the wash liquid is likely to leak out. Such leakage can be taken into account when determining the average storage capacity of each spray assemblies 26, 28, 30. However, the spray assemblies 26, 28, 30 may be provided with a mechanism, such as a valve or sliding plate, for closing the outlets of the spray assemblies 26, 28, 30 to prevent leakage.

Furthermore, if the dishwasher 10 includes a separate storage tank (not shown), the method can further include directing wash liquid into the storage tank to store the wash liquid for later reuse. This would permit a greater quantity of wash liquid to be stored and reused.

The invention described herein provides a method for storing and reusing wash liquid in a dishwasher. The method negates the problem of allocating space for a storage tank by utilizing the existing structure of the dishwasher to store wash liquid. Specifically, the method of the invention uses the spray system to store wash liquid. A separate tank is not needed to store wash liquid for later reuse, and no dedicated plumbing is required. This conserves space within the dishwasher, and can help minimize the footprint and/or overall volume of the dishwasher 10. Current dishwashers do not store wash liquid within the spray system because many do not have any mechanism for trapping wash liquid in the spray system, and some dishwashers even have intentional gaps or leaks in the spray system to allow wash liquid to completely drain from the spray system at the end of a cycle of operation. While some current dishwashers are provided with a diverter mechanism for selectively directing wash liquid to different sprayers, it is typical to open the diverter mechanism and only operate the drain pump at the end of the cycle to ensure all wash liquid is drained. The method of the present invention purposefully choreographs the operation of the recirculation system, i.e. the wash pump 36, and the diverter mechanism 56 at or near the end of a cycle of operation to store wash liquid within the spray system of the dishwasher 10 for later reuse.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a treating chamber supplied with wash liquid by a spray system having multiple, independent supply conduits each terminating in at least one sprayer, the method comprising:

introducing wash liquid into the treating chamber;

recirculating the wash liquid from the treating chamber to the spray system;

while recirculating the wash liquid, actuating a diverter valve to sequentially fluidly couple the recirculating wash liquid to sequential ones of the supply conduits to sequentially supply the recirculated wash liquid to the supply conduits to store the wash liquid in all of the supply conduits;

terminating the recirculation of wash liquid when a predetermined amount of wash liquid is stored;

actuating the diverter valve such that the stored wash liquid is retained in all of the supply conduits when the recirculation of the wash liquid is terminated; and draining any remaining wash liquid from a sump of the treating chamber.

2. The method of claim 1, wherein actuating the diverter valve to sequentially supply the recirculated wash liquid to the supply conduits comprises sequentially advancing the diverter valve from the current supply conduit to the next supply conduit when the current supply conduit reaches a filled condition.

3. The method of claim 1, wherein actuating the diverter valve to retain the wash liquid stored in the supply conduits comprises fluidly uncoupling the diverter valve from all of the supply conduits.

4. The method of claim 1, wherein the recirculating comprises filtering the wash liquid prior to storing the wash liquid in the supply conduits.

5. The method of claim 1, wherein the terminating the recirculation comprises terminating the recirculation of wash liquid when the liquid supply conduits reach a filled condition with wash liquid.

6. The method of claim 1, wherein the predetermined amount of wash liquid comprises an amount of wash liquid approximately equal to a maximum capacity of the spray system.

7. The method of claim 1, further comprising draining a predetermined amount of the wash liquid from the sump prior to the recirculating the wash liquid.

8. The method of claim 1, further comprising recirculating the liquid through the treating chamber to remove soils from any utensils within the treating chamber and to form the wash liquid.

9. The method of claim 1, wherein actuating the diverter valve to retain the wash liquid stored in the supply conduits comprises positioning the diverter such that a pump is fluidly decoupled from all the supply conduits of the spray system.

* * * * *